US008142246B2

(12) United States Patent
Kadobayashi et al.

(10) Patent No.: US 8,142,246 B2
(45) Date of Patent: Mar. 27, 2012

(54) FUEL SUPPLY SYSTEM FOR BOAT AND OUTBOARD MOTOR

(75) Inventors: Yoshiyuki Kadobayashi, Shizuoka (JP); Masahiko Kato, Shizuoka (JP); Toru Tsuchiya, Odawara (JP); Toshiki Ogasawara, Odawara (JP)

(73) Assignees: Yamaha Hatsudoki Kabushiki Kaisha, Shizuoka (JP); Mikuni Corporation, Tokyo (JP)

( * ) Notice: Subject to any disclaimer, the term of this patent is extended or adjusted under 35 U.S.C. 154(b) by 323 days.

(21) Appl. No.: 12/489,463

(22) Filed: Jun. 23, 2009

(65) Prior Publication Data

US 2009/0325432 A1 Dec. 31, 2009

(30) Foreign Application Priority Data

Jun. 25, 2008 (JP) ..... 2008-166091

(51) Int. Cl.
*F02M 37/00* (2006.01)

(52) U.S. Cl. ..... 440/88 F

(58) Field of Classification Search ..... 440/88 R, 440/88 F; 123/468, 469, 470, 471, 472, 511, 123/514

See application file for complete search history.

(56) References Cited

U.S. PATENT DOCUMENTS

| | | | | |
|---|---|---|---|---|
| 5,115,784 | A * | 5/1992 | Mito et al. | 123/516 |
| 5,555,858 | A * | 9/1996 | Katoh | 123/73 SC |
| 5,984,743 | A * | 11/1999 | Wada et al. | 440/88 R |
| 2008/0245346 | A1 * | 10/2008 | Onishi et al. | 123/514 |
| 2009/0194074 | A1 * | 8/2009 | Radue et al. | 123/509 |

FOREIGN PATENT DOCUMENTS

JP 2007-309182 A 11/2007

* cited by examiner

*Primary Examiner* — Lars A Olson
*Assistant Examiner* — Anthony Wiest
(74) *Attorney, Agent, or Firm* — Keating & Bennett, LLP

(57) ABSTRACT

A fuel supply system for a boat, which prevents fuel piping from becoming complicated, includes a vapor separator unit connected to a fuel tank that is mounted on a hull and holds fuel supplied to an engine section, a low-pressure pump arranged to discharge the fuel reserved in the fuel tank into the vapor separator unit, and a mounting hole for a valve, a fuel passage section, and a pipe section (relief path) that return the fuel discharged by the low-pressure pump to the suction opening section side of the low-pressure pump when a tank section is filled with a predetermined amount of fuel. The mounting hole for the valve, the fuel passage section, and the pipe section (relief path) are integral with the vapor separator unit.

17 Claims, 6 Drawing Sheets

FUEL SUPPLY SYSTEM FOR BOAT AND OUTBOARD MOTOR

BACKGROUND OF THE INVENTION

1. Field of the Invention

The present invention relates to a fuel supply system for a boat and an outboard motor. Specifically, the present invention relates to a fuel supply system for a boat having a second fuel tank connected to a first fuel tank mounted on a hull and an outboard motor.

2. Description of the Related Art

Conventionally, a fuel supply system for a boat having a second fuel tank connected to a first fuel tank mounted on a hull is known (see JP-A-2007-309182, for example). In JP-A-2007-309182, there is disclosed an outboard motor including a vapor separator (second fuel tank) for reserving fuel supplied from a fuel tank mounted on a hull; a low-pressure pump (fuel supply pump) for discharging the fuel reserved in the fuel tank to the vapor separator; and a relief path through which the fuel discharged by the low-pressure pump is returned to the suction side of the low-pressure pump when the vapor separator is filled with a predetermined amount of fuel. The relief path of the outboard motor according to JP-A-2007-309182 is configured to be connected to a plurality of fuel pipes at a location that is different from the location where the vapor separator is disposed.

However, in JP-A-2007-309182, since the relief path of the outboard motor is configured to be connected to the plurality of fuel pipes at a location that is different from the location where the vapor separator is disposed, fuel piping becomes complicated.

SUMMARY OF THE INVENTION

In view of the above problems, preferred embodiments of the present invention provide a fuel supply system for a boat and an outboard motor that prevent fuel piping from becoming complicated.

A fuel supply system for a boat according to a preferred embodiment of the present invention includes a second fuel tank connected to a first fuel tank that is mounted on a hull and contains fuel supplied to an engine, a fuel supply pump arranged to discharge the fuel reserved in the first fuel tank to the second fuel tank side, and a relief path through which the fuel discharged by the fuel supply pump is returned to the suction side of the fuel supply pump when the second fuel tank is filled with a predetermined amount of fuel, and the second fuel tank is integral with the relief path.

As described above, the relief path is preferably integral with the second fuel tank, which is different from the case where the relief path is configured to be connected to a plurality of piping members. This prevents the relief path from becoming complicated. Thus, fuel piping can be prevented from becoming complicated.

Preferably, the second fuel tank is also integral with a fuel supply path to connect the discharge side of the fuel supply pump and a tank section of the second fuel tank. With this configuration, because the fuel supply path is integral with the second fuel tank, the fuel supply path can be prevented from becoming complicated. Thus, the fuel piping including the relief path and the fuel supply path can further be prevented from becoming complicated.

In the fuel supply system for a boat in which the second fuel tank is integral with the fuel supply path, preferably, an inlet through which fuel flows into the tank section of the second fuel tank is provided in the tank section side of the fuel supply path integrally provided in the second fuel tank, and the fuel supply system further includes a closing member disposed in the tank section of the second fuel tank to close the inlet when the tank section of the second fuel tank is filled with the predetermined amount of fuel. With this configuration, it is easy with the closing member to prevent fuel from excessively flowing into the tank section of the second fuel tank.

In the fuel supply system for a boat in which the inlet is provided, preferably, the fuel supply path is also connected to the relief path, and the fuel supply system further includes a filter positioned in the fuel supply path as well as in the upstream side of the relief path and the upstream side of the inlet. With this configuration, a relief valve that is, for example, provided in the relief path can be protected from foreign matters contained in the fuel, and the closing member can be protected from foreign matters.

In this case, the filter is preferably arranged to cover the relief path and the inlet. With this configuration, it is possible with the filter to reliably protect the relief path and the inlet.

In the fuel supply system for a boat in which the second fuel tank is integral with the fuel supply path, preferably, the second fuel tank includes a tank body and a first cover member arranged to cover an upper portion of the tank body and the fuel supply path is integral with the first cover member of the second fuel tank. With this configuration, the fuel supply path can be formed simultaneously with the first cover member.

In the fuel supply system for a boat in which the second fuel tank is made up of the tank body and the first cover member, the relief path is preferably integral with the second fuel tank so as to lie astride the tank body and the first cover member. With this configuration, the relief path can be formed simultaneously with the tank body and the first cover member.

In the fuel supply system for a boat in which the second fuel tank is made up of the tank body and the first cover member, a suction opening of the fuel supply pump is preferably attached to the tank body of the second fuel tank so as to be connected to the relief path. With this configuration, no piping member such as a hose is required between the suction opening of the fuel supply pump and the tank body, thereby preventing fuel piping from becoming complicated.

In the fuel supply system for a boat in which the second fuel tank is made up of the tank body and the first cover member, a discharge opening of the fuel supply pump is preferably attached to the first cover member of the second fuel tank so as to be connected to the fuel supply path. With this configuration, no piping member such as a hose is required between the discharge opening of the fuel supply pump and the first cover member, thereby preventing fuel piping from becoming complicated.

Preferably, the fuel supply system for a boat according to a preferred embodiment of the present invention further includes a cooling section through which cooling water is flowed and that is located on an outer wall section of the second fuel tank and cools the second fuel tank. With this configuration, it is possible with the cooling section to cool the inside of the second fuel tank via the outer wall section of the second fuel tank.

The cooling section is preferably configured to cool the fuel flowed through the relief path and the fuel reserved in the tank section of the second fuel tank. With this configuration, it is possible to cool the fuel that is flowed through the relief path and returned to the suction side of the fuel supply pump and restrain the fuel reserved in the tank section from vaporizing.

In the fuel supply system for a boat provided with the cooling section, preferably, the cooling section includes a second cover member configured to cover the outer wall section of the second fuel tank and is configured such that cooling water flows between the second cover member and the outer wall section of the second fuel tank. With this configuration, since cooling water directly contacts the outer wall section of the second fuel tank, the inside of the second fuel tank can be effectively cooled.

In the fuel supply system for a boat according to a preferred embodiment of the present invention, the relief path is preferably configured to house the fuel supply pump. With this configuration, the relief path covers the fuel supply pump, thereby protecting the fuel supply pump from physical shock.

In the fuel supply system for a boat according to a preferred embodiment of the present invention, the relief path preferably includes a relief valve that is disposed in the vicinity of the suction opening of the fuel supply pump in the relief path and allows fuel to flow into the suction opening side of the fuel supply pump when the second fuel tank is filled with the predetermined amount of fuel. With this configuration, fuel can easily be returned to the suction opening side of the fuel supply pump when the second fuel tank is filled with the predetermined amount of fuel.

An outboard motor according to another preferred embodiment of the present invention includes an engine, a second fuel tank connected to a first fuel tank that is mounted on a hull and contains fuel supplied to the engine, a fuel supply pump arranged to discharge the fuel reserved in the first fuel tank to a second fuel tank side, and a relief path through which the fuel discharged by the fuel supply pump is returned to the suction side of the fuel supply pump when the second fuel tank is filled with a predetermined amount of fuel, and the second fuel tank is integral with the relief path.

As described above, the relief path is preferably integral with the second fuel tank, which is different from the case where the relief path is configured to be connected to a plurality of piping members. This prevents the relief path from becoming complicated. Thus, fuel piping can be prevented from becoming complicated.

Other features, elements, arrangements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will be described in the following sections based on the drawings.

First Preferred Embodiment

Figure 1:
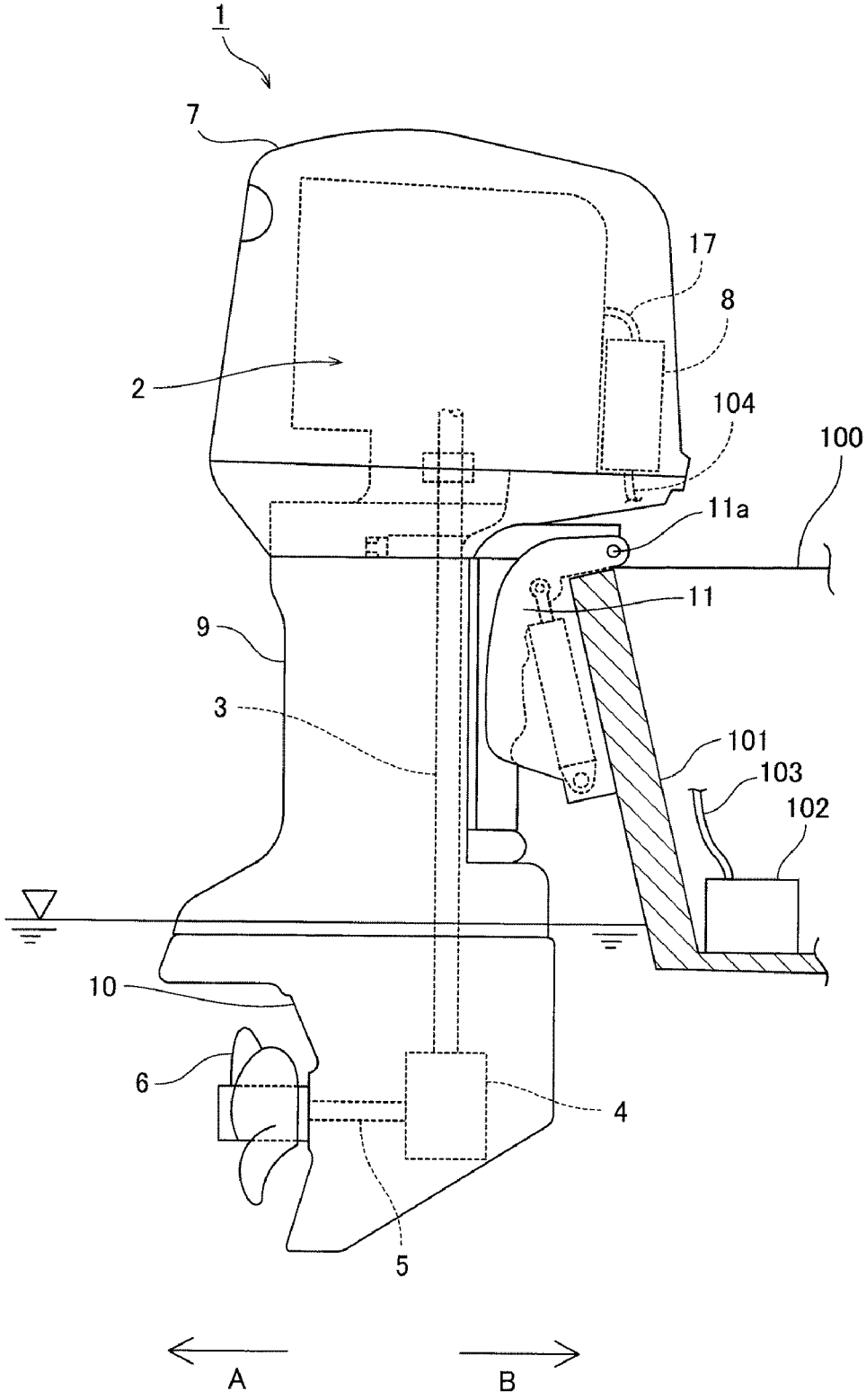
FIG. 1 is a side view showing a general construction of an outboard motor according to a first preferred embodiment of the present invention.
Figure 2:
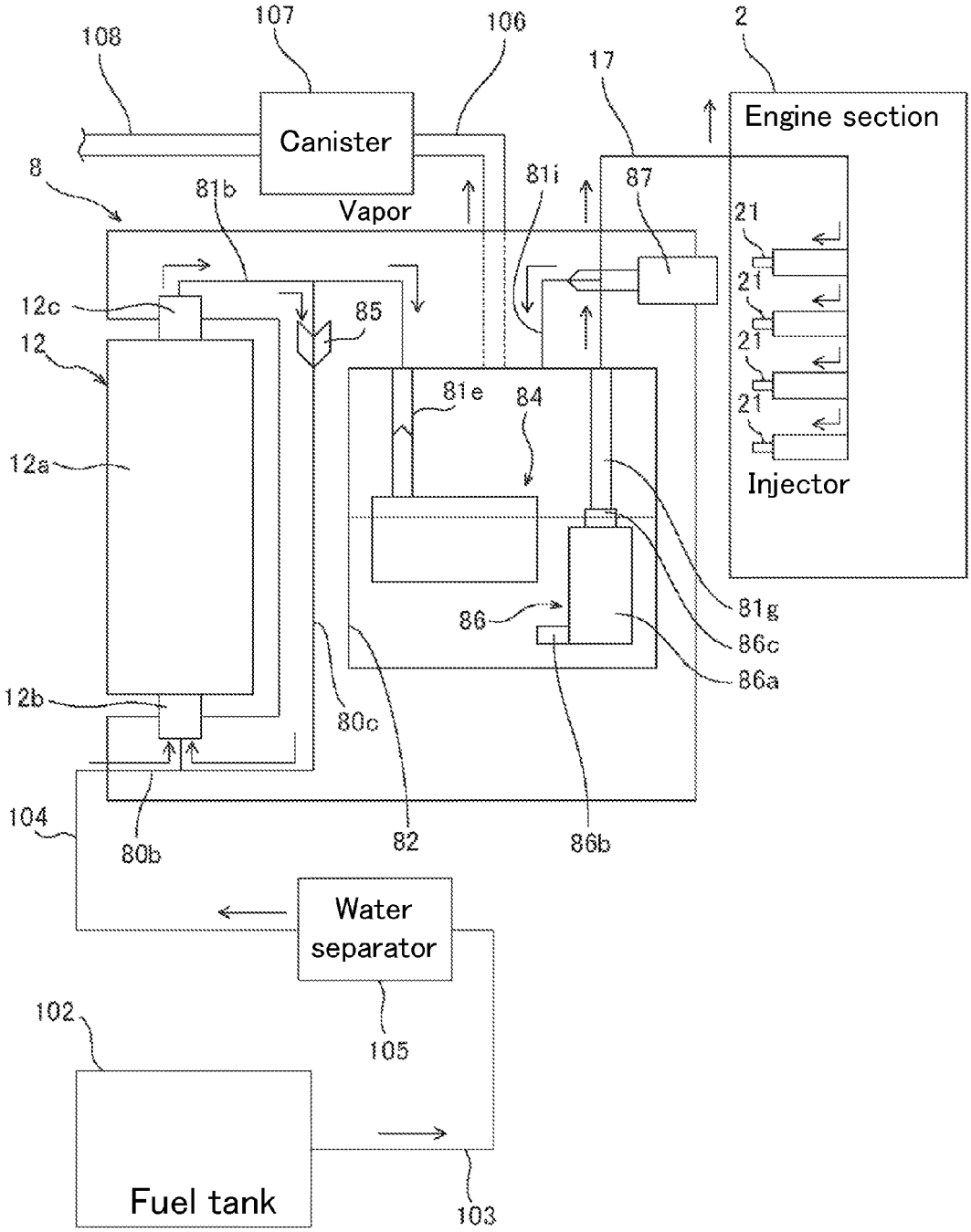
FIG. 2 is a schematic diagram illustrating the construction of the outboard motor according to the first preferred embodiment shown in FIG. 1.
Figure 3:
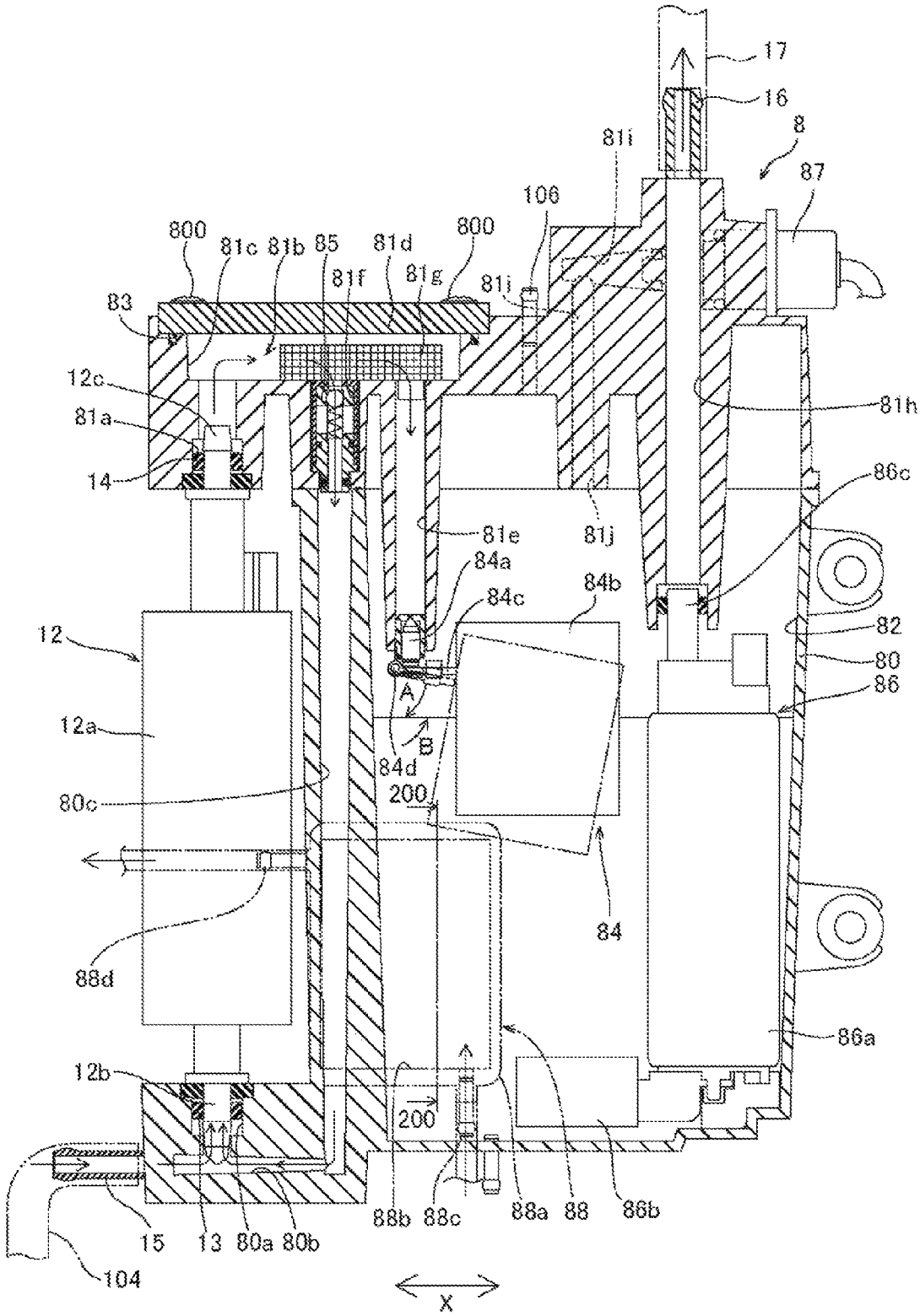
FIG. 3 is a cross-sectional view showing the construction of a vapor separator unit of the outboard motor according to the first preferred embodiment shown in FIG. 1.
Figure 4:
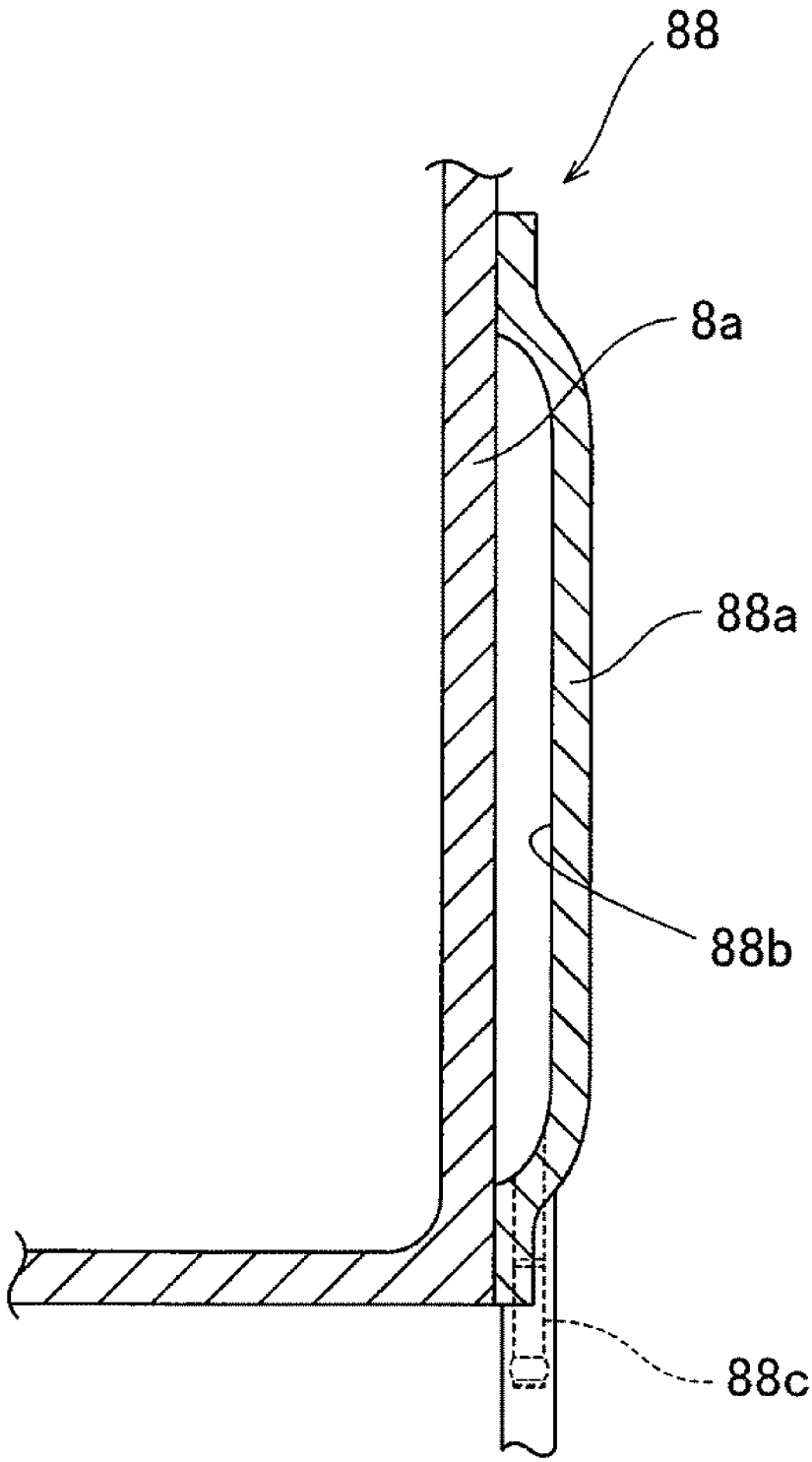
FIG. 4 is a cross-sectional view taken along the line 200-200 in FIG. 3.

FIG. 1 is a side view showing an overall configuration of an outboard motor that includes a fuel supply system for a boat according to a first preferred embodiment of the present invention. FIGS. 2 to 4 illustrate the configuration of the outboard motor that includes the fuel supply system for a boat shown in FIG. 1. First, referring to FIGS. 1 to 4, the structure of an outboard motor 1 provided with a fuel supply system for a boat according to the first preferred embodiment of the present invention will be described.

As shown in FIG. 1, the outboard motor 1 includes an engine section 2, a drive shaft 3 that is rotated by the driving force of the engine section 2 and extends vertically, a forward/reverse changing mechanism 4 connected to the lower end of the drive shaft 3, a propeller shaft 5 that is connected to the forward/reverse changing mechanism 4 and extends horizontally, and a propeller 6 attached to a rear end of the propeller shaft 5. The engine section 2 is housed in a cowling 7. A vapor separator unit 8 is housed in the cowling 7 to be positioned adjacent to the engine section 2. Note that the vapor separator unit 8 is an example of the "second fuel tank" according to a preferred embodiment of the present invention. The structure of the vapor separator unit 8 will be described in detail later. In an upper case 9 and a lower case 10 arranged below the cowling 7, the drive shaft 3, the forward/reverse changing mechanism 4, and the propeller shaft 5 are housed. The outboard motor 1 is mounted to a transom plate 101 provided on a reverse direction (direction of an arrow "A") side of a hull 100 via a clamp bracket 11. The clamp bracket 11 supports the outboard motor 1 pivotally around a tilt shaft 11*a* in a vertical direction with respect to the hull 100. A fuel tank 102 for holding fuel (gasoline) is provided on the hull 100. Note that the engine section 2 is an example of the "engine" according to a preferred embodiment of the present invention while the fuel tank 102 is an example of the "first fuel tank" according to a preferred embodiment of the present invention.

As shown in FIG. 2, the fuel tank 102 and the vapor separator unit 8 of the outboard motor 1 are connected by fuel pipes 103 and 104. A water separator 105 is provided between the fuel pipe 103 and the fuel pipe 104. The water separator 105 has a function to eliminate water and the like from the fuel transported from the fuel tank 102 to the vapor separator unit 8. The engine section 2 of the outboard motor 1 is driven using fuel supplied from the fuel tank 102 via the vapor separator unit 8. The propeller 6 is rotated by the driving force of the engine section 2, and a rotational direction of the propeller 6 is changed by the forward/reverse changing mechanism 4. Thus, the hull 100 is propelled in a forward direction (direction of an arrow "B") or in a reverse direction (direction of the arrow "A").

In the first preferred embodiment, as shown in FIG. 3, the vapor separator unit 8 preferably includes a unit main body 80 that constitutes the main portion of the vapor separator unit 8 and a cover member 81 for covering the upper portion of the unit main body 80. Note that the cover member 81 is an example of the "first cover member" according to a preferred embodiment of the present invention. The unit main body 80 and the cover member 81 of the vapor separator unit 8 are preferably formed by casting, for example. The vapor separator unit 8 is configured to reserve fuel supplied from the fuel tank 102 via a low-pressure pump 12 which will be described later.

The vapor separator unit 8 includes a tank section 82 for reserving fuel supplied to the engine section 2. The tank section 82 is enclosed with the unit main body 80 and the cover member 81. As shown in FIGS. 2 and 3, the low-pressure pump 12 is attached to the vapor separator unit 8 so as to suction the fuel reserved in the fuel tank 102 and discharge the suctioned fuel into the tank section 82. Note that the low-pressure pump 12 is an example of the "fuel supply pump" according to a preferred embodiment of the present invention.

The low-pressure pump 12 includes a pump main body 12*a* that constitutes the main portion of the low-pressure pump 12, a suction opening section 12*b* for suctioning fuel, and a discharge opening section 12*c* for discharging the suctioned fuel. Note that the suction opening section 12*b* is an example of the "suction opening" according to a preferred embodiment of the present invention while the discharge opening section 12*c* is an example of the "discharge opening" according to a preferred embodiment of the present invention. As shown in FIG. 3, the suction opening section 12*b* of the low-pressure pump 12 is attached to the unit main body 80 of the vapor separator unit 8 while the discharge opening section 12*c* of the low-pressure pump 12 is attached to the cover member 81 of the vapor separator unit 8. Specifically, a mounting hole 80*a* for suction opening to which the suction opening section 12*b* of the low-pressure pump 12 is attached is formed on the unit main body 80 of the vapor separator unit 8. In the mounting hole 80*a* for suction opening, the suction opening section 12*b* of the low-pressure pump 12 is fitted via a seal member 13. Also, a mounting hole 81*a* for discharge opening to which the discharge opening section 12*c* of the low-pressure pump 12 is attached is provided on the cover member 81 of the vapor separator unit 8. In the mounting hole 81*a* for discharge opening, the discharge opening section 12*c* of the low-pressure pump 12 is fitted via a seal member 14.

In the first preferred embodiment, as shown in FIGS. 2 and 3, a fuel passage section 80*b* is formed below the mounting hole 80*a* for suction opening (see FIG. 3) on the unit main body 80 (see FIG. 3) of the vapor separator unit 8. As shown in FIG. 3, the fuel passage section 80*b* is arranged to extend horizontally and is provided with a pipe mounting member 15 that is inserted into one side thereof. The fuel pipe 104 is connected to the pipe mounting member 15. An upper surface of the fuel passage section 80*b* is connected to the lower end of the mounting hole 80*a* for suction opening. With this configuration, the fuel flowed from the pipe mounting member 15 is allowed to be suctioned into the low-pressure pump via the fuel passage section 80*b* and the mounting hole 80*a* for suction opening (suction opening section 12*b*).

In the first preferred embodiment, a fuel passage section 81*b* is formed above the mounting hole 81*a* for discharge opening in the cover member 81 of the vapor separator unit 8. Note that the fuel passage section 81*b* is an example of the "fuel supply path" according to a preferred embodiment of the present invention. The fuel passage section 81*b* preferably includes a channel section 81*c* formed in an upper surface of the cover member 81 to extend horizontally (in "X" direction in FIG. 3) and a metallic lid member 81*d* for covering the channel section 81*c*. A seal member 83 is provided between an outer periphery of the channel section 81*c* and a lower surface of the lid member 81*d*. The lid member 81*d* is screwed to the cover member 81 with screws 800. One side of the channel section 81*c* of the fuel passage section 81*b* is connected to the upper end of the mounting hole 81*a* for discharge opening.

A pipe section 81*e* extending downward is provided in the other side of the channel section 81*c* of the fuel passage section 81*b*. Note that the pipe section 81*e* is an example of the "fuel supply path" and the "inlet" according to a preferred embodiment of the present invention. The pipe section 81*e* is preferably integral with the cover member 81 of the vapor separator unit 8 and connected to the other side of the channel section 81*c*. The lower end of the pipe section 81*e* is positioned inside the tank section 82 of the vapor separator unit 8. As described above, the fuel supply path preferably includes the mounting hole 81*a* for discharge opening, the fuel passage section 81*b*, and the pipe section 81*e*. The fuel discharged from the low-pressure pump 12 can be flowed into the inside of the tank section 82 via the fuel supply path.

In the first preferred embodiment, a float valve 84 is preferably disposed in the tank section 82. Note that the float valve 84 is an example of the "closing member" according to a preferred embodiment of the present invention. The float valve 84 preferably includes a needle valve 84*a* and a float section 84*b*. The needle valve 84*a* is positioned in the pipe section 81*e* and has a function to adjust a flow rate of the fuel flowed from the pipe section 81*e* into the tank section 82. The float section 84*b* is disposed in the tank section 82 so as to be floatable on the level of the fuel reserved in the tank section 82. The needle valve 84*a* and the float section 84*b* are connected by a lever member 84*c*. When the level of the fuel reserved in the tank section 82 drops below a predetermined level, the float section 84*b* is moved downward along with the level of the fuel and the lever member 84*c* is rotated about a rotation axis 84*d* in "A" direction. The needle valve is configured to be open as the lever member 84*c* rotates in "A" direction. In other words, when the level of the fuel reserved in the tank section 82 drops below the predetermined level, the float valve 84 is configured to operate such that the needle valve 84*a* is opened to allow fuel to flow into the tank section 82 from the pipe section 81*e*.

When the level of the fuel reserved in the tank section 82 exceeds the predetermined level, the float section 84*b* is moved upward along with the level of the fuel and the lever member 84*c* is rotated about the rotation axis 84*d* in "B" direction. The needle valve 84*a* is configured to be closed as the lever member 84*c* rotates in "B" direction. In other words, when the level of the fuel reserved in the tank section 82 exceeds the predetermined level, the float valve 84 is configured to operate such that the needle valve 84*a* is closed to reduce the flow rate of the fuel flowed into the tank section 82 from the pipe section 81*e*. Further, when the tank section 82 is filled with a predetermined amount of fuel, the float valve 84 is configured to operate such that the needle valve 84*a* is closed to close the pipe section 81*e*.

In the first preferred embodiment, as shown in FIG. 3, a mounting hole 81*f* is provided in the channel section 81*c* of the fuel passage section 81*b* to be sandwiched between the mounting hole 81*a* for discharge opening and the pipe section 81*e*. The mounting hole 81*f* for a valve is configured to penetrate downward from the bottom of the channel section 81*c*. A relief valve 85 is mounted in the mounting hole 81*f*. The relief valve 85 has a function to flow fuel to the suction opening section 12*b* side of the low-pressure pump 12 when the tank section 82 is filled with the predetermined amount of fuel.

In this preferred embodiment, the lower portion of the mounting hole 81*f* for relief valve 85 is connected to the upper portion of a pipe section 80*c*. The pipe section 80*c* is preferably integral with the unit main body 80 of the vapor separator unit 8 to extend vertically. As shown FIGS. 2 and 3, the lower portion of the pipe section 80*c* is connected to the other side of the fuel passage section 80*b*. That is, as shown in FIG. 3, the relief valve 85 is configured to be connected to the suction opening section 12*b* of the low-pressure pump 12.

As configured as described above with the mounting hole 81*f* for relief valve 85, the pipe section 80*c*, and the fuel passage section 80*b*, it is possible to release fuel outward (to the suction side of the low-pressure pump 12) via the relief valve 85, the pipe section 80*c*, and the fuel passage section 80*b* when pressure applied to the fuel flowing through the fuel passage section 80*b* is larger than a predetermined value. In other words, when the needle valve 84*a* of the float valve 84 is closed due to the fact that the tank section 82 is filled with the predetermined amount of fuel, fuel is returned to the suction side of the low-pressure pump 12. Note that the mounting hole 81*f* for relief valve 85 and the pipe section 80*c* constitute the "relief path" according to a preferred embodiment of the present invention.

A filter 81*g* is disposed upstream of the mounting hole 81*f* for relief valve 85 of the fuel passage section 81*b* as well as upstream of the pipe section 81*e*. The filter 81*g* is arranged to cover the mounting hole 81*f* and the pipe section 81*e*. Since the filter 81*g* extends in "X" direction, it can filter out foreign matters over a wider area than the case where a filter is disposed only above the mounting hole 81*f* or only above the pipe section 81*e*. Thus, the life of the filter 81*g* can be extended.

As shown in FIGS. 2 and 3, a high-pressure pump 86 for discharging the fuel reserved in the tank section 82 to the engine section 2 side is disposed in the tank section 82 of the vapor separator unit 8. The high-pressure pump 86 includes a pump main body 86*a* that constitutes the main part of the high-pressure pump 86, a suction opening section 86*b* for suctioning the fuel reserved in the tank section 82, and a discharge opening section 86*c* for discharging the suctioned fuel. The pump main body 86*a* is disposed lower than the level of the fuel reserved in the tank section 82. The suction opening section 86*b* is positioned in the vicinity of the bottom of the tank section 82. The discharge opening section 86*c* is configured to extend upward from the pump main body 86*a*.

The discharge opening section 86*c* of the high-pressure pump 86 is connected to the lower end of a pipe section 81*h*. As shown in FIG. 3, the pipe section 81*h* is preferably integral with the cover member 81 of the vapor separator unit 8. The pipe section 81*h* is arranged to extend in the vertical direction. A pipe attaching member 16 is attached to the upper end of the pipe section 81*h*. The pipe attaching member 16 is connected to an injector 21 (see FIG. 2) in the engine section 2 (see FIG. 2) via a fuel hose 17 and so forth.

A pressure regulator 87 is installed in the pipe section 81*h*. The pressure regulator 87 has a function to adjust the pressure (pressure in the pipe section 81*h*) of the fuel transported to the injector 21 in order to keep the injected amount of the fuel from the injector 21 at the constant level. As shown in FIGS. 2 and 3, a return passage section 81*i* is connected to the pressure regulator 87. When the pressure regulator 87 adjusts pressure in the pipe section 81*h*, the fuel flowing through the pipe section 81*h* is released into the tank section 82 utilizing the return passage section 81*i*. As shown in FIG. 3, an outlet 81*j* of the return passage section 81*i* is positioned above the level of the fuel reserved in the tank section 82.

In the first preferred embodiment, a cooling section 88 for cooling the vapor separator unit 8 is provided on an outer wall section 8*a* (see FIG. 4) of the vapor separator unit 8. The cooling section 88 is configured to flow cooling water. The cooling section 88 is configured to cool the fuel flowing through the pipe section 80*c* and the fuel reserved in the tank section 82. Specifically, as shown in FIG. 4, in the cooling section 88, a cover member 88*a* is attached to cover the outer wall section 8*a* of the vapor separator unit 8. Note that the cover member 88*a* is an example of the "second cover member" according to a preferred embodiment of the present invention. A hollow section 88*b* is provided between the cover member 88*a* and the outer wall section 8*a* of the vapor separator unit 8. As shown in FIG. 3, a pipe 88*c* is connected to the lower portion of the hollow section 88*b* and a pipe 88*d* is connected to the upper portion of the hollow section 88*b*. The pipe 88*c* is utilized to draw the seawater (cooling water) pumped by a water pump (not shown) in the engine section 2 into the hollow section 88*b*. The pipe 88*d* is utilized to drain the seawater (cooling water) flowed into the hollow section 88*b*. That is, the cooling section 88 is, as shown in FIG. 4, configured such that seawater (cooling water) is flowed between the cover member 88*a* and the outer wall section 8*a* of the vapor separator unit 8. With the configuration of the cooling section 88 as described above, it is possible to cool the vapor separator unit 8.

As shown in FIG. 2, a vapor lead-out passage 106 through which the vapor generated by vaporization of the fuel reserved in the tank section 82 is released is provided in the tank section 82 of the vapor separator unit 8. The vapor lead-out passage 106 is connected to a canister 107. The canister 107 has a function to liquidize the fuel (vapor) vaporized by the tank section 82. The canister 107 is connected to a mixing chamber (not shown) in the engine section 2 via a vapor lead-out passage 108 and so forth.

In the first preferred embodiment, as described above, the relief path, which preferably includes the fuel passage section 80*b*, the pipe section 80*c*, and the mounting hole 81*f*, through which the fuel discharged by the low-pressure pump 12 is returned to the suction side of the low-pressure pump 12 is preferably integral with the vapor separator unit 8. Therefore, the relief path, which preferably includes the fuel passage section 80*b*, the pipe section 80*c*, and the mounting hole 81*f*, can be prevented from becoming complicated, in contrast to the case where the relief path is configured to be connected to a plurality of piping members. Thus, fuel piping can be prevented from becoming complicated.

In the first preferred embodiment, as described above, the fuel passage section 81*b* and pipe section 81*e* that connect between the discharge opening section 12*c* side of the low-pressure pump 12 and the tank section 82 of the vapor separator unit 8 preferably are integral with the vapor separator unit 8. As a result, the fuel passage section 81*b* and pipe section 81*e* are prevented from becoming complicated. Thus, the fuel piping including the relief path, which preferably includes the fuel passage section 80*b*, the pipe section 80*c*, and the mounting hole 81*f*, and the fuel supply path, which preferably includes the fuel passage section 81*b* and pipe section 81*e*, can be prevented from becoming complicated.

In the first preferred embodiment, as described above, the float valve 84 is provided in the tank section 82 of the vapor separator unit 8 to close the pipe section 81*e* (inlet) when the tank section 82 of the vapor separator unit 8 is filled with the predetermined amount of fuel. With the float valve 84, it is easy to prevent fuel from excessively flowing into the tank section 82 of the vapor separator unit 8.

In the first preferred embodiment, as described above, the filter 81*g* is disposed in the fuel passage section 81*b* upstream of the mounting hole 81*f* as well as upstream of the pipe section 81*e*, thereby protecting the relief valve 85 provided in the mounting hole 81*f* and the needle valve 84*a* provided in the pipe section 81*e* from foreign matters contained in the fuel.

In the first preferred embodiment, as described above, the filter 81*g* is preferably arranged to cover the mounting hole 81*f* and the pipe section 81*e*, thereby reliably protecting the mounting hole 81*f* and the pipe section 81*e*.

In the first preferred embodiment, as described above, the fuel passage section 81*b* and the pipe section 81*e* preferably are integral with the cover member 81 of the vapor separator unit 8. Accordingly, the fuel passage section 81*b* and the pipe section 81*e* can be formed simultaneously with the cover member 81.

In the first preferred embodiment, as described above, the fuel passage section 80*b* and the pipe section 80*c* preferably are integral with the vapor separator unit 8 so as to lie astride the unit main body 80 and the cover member 81. Accordingly, the fuel passage section 80*b* and the pipe section 80*c* can be formed simultaneously with the unit main body 80 and the cover member 81 of the vapor separator unit 8.

In the first preferred embodiment, as described above, the suction opening section 12*b* of the low-pressure pump 12 is attached to the unit main body 80 of the vapor separator unit 8 to be connected to the fuel passage section 80*b* and the pipe section 80*c*. Accordingly, no piping member such as a hose is required between the suction opening section 12*b* of the low-pressure pump 12 and the unit main body 80, thereby preventing fuel piping from becoming complicated.

In the first preferred embodiment, as described above, the discharge opening section 12*c* of the low-pressure pump 12 is attached to the cover member 81 of the vapor separator unit 8 to be connected to the fuel passage section 81*b* and the pipe section 81*e*. Accordingly, no piping member such as a hose is required between the discharge opening section 12*c* of the low-pressure pump 12 and the cover member 81, thereby preventing fuel piping from becoming complicated.

In the first preferred embodiment, as described above, the cooling section 88 configured to flow cooling water is provided on the outer wall section 8*a* of the vapor separator unit 8. With the cooling section 88, it is possible to cool the inside of the vapor separator unit 8 via the outer wall section 8*a* of the vapor separator unit 8.

In the first preferred embodiment, as described above, the cooling section 88 is configured to flow cooling water between the cover member 88*a* and the outer wall section 8*a* of the vapor separator unit 8. Thus, cooling water directly contacts the outer wall section 8*a* of the vapor separator unit 8, thereby effectively cooling the inside of the vapor separator unit 8.

In the first preferred embodiment, as described above, the cooling section 88 is configured to cool the fuel flowing through the pipe section 80*c* and the fuel reserved in the tank section 82. Therefore, the fuel flowing through the pipe section 80*c* to return to the suction opening section 12*b* side of the low-pressure pump 12 can be cooled and vaporization of the fuel reserved in the tank section 82 can be prevented.

Second Preferred Embodiment

Figure 5:
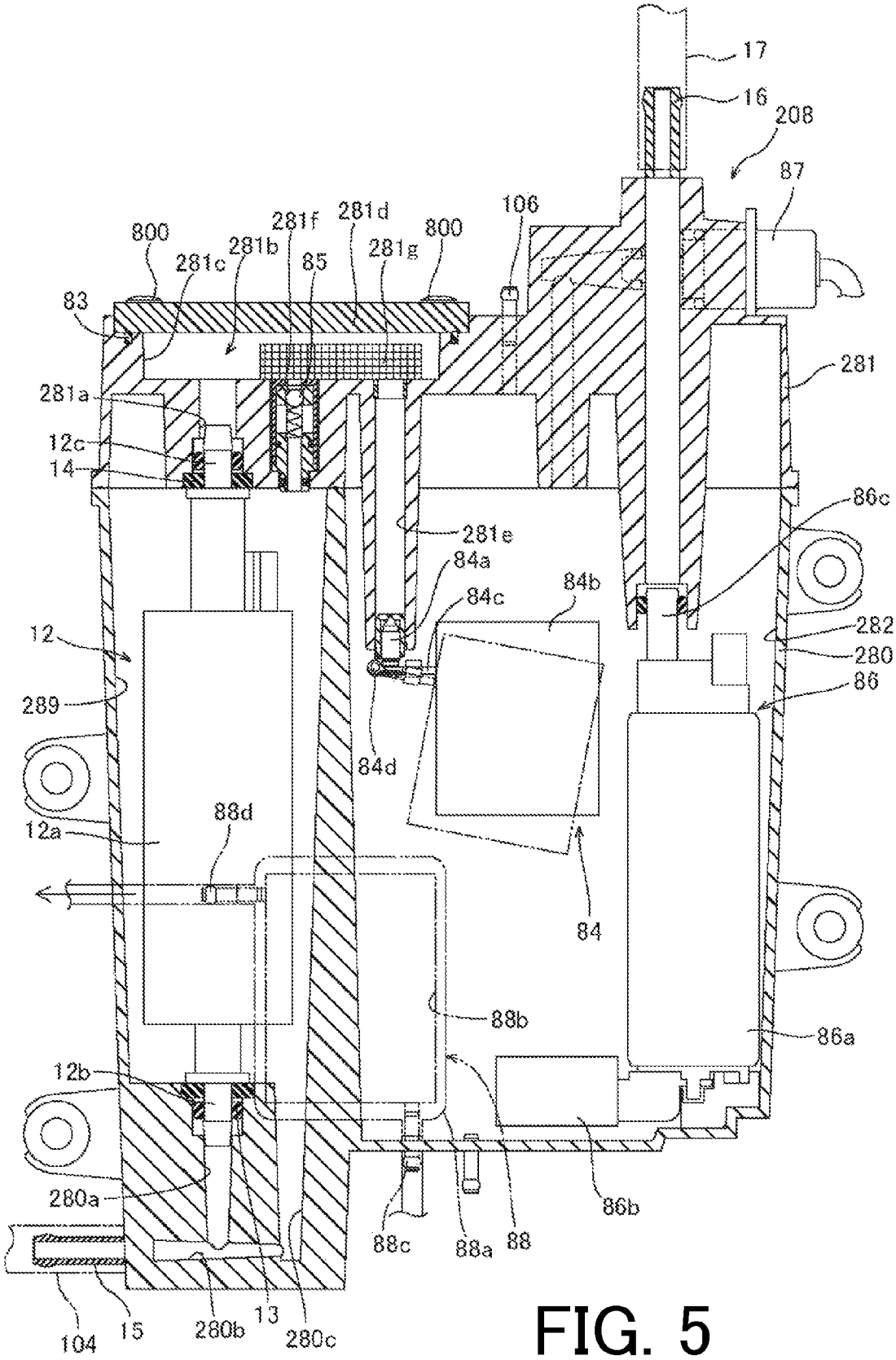
FIG. 5 is a cross-sectional view showing the construction of a vapor separator unit of an outboard motor according to a second preferred embodiment of the present invention.

FIG. 5 is a cross-sectional view illustrating the construction of a vapor separator unit of an outboard motor according to a second preferred embodiment of the present invention. The structure of the vapor separator unit of the outboard motor according to the second preferred embodiment of the present invention will be described hereinafter in detail with reference to FIG. 5. In contrasts to the first preferred embodiment, there is described in the second preferred embodiment an example in which the low-pressure pump 12 is housed in a low-pressure pump housing section 289 that constitutes a relief path provided in a vapor separator unit 208.

In the second preferred embodiment, as shown in FIG. 5, the vapor separator unit 208 is made up of a unit main body 280 that constitutes the main portion of the vapor separator unit 208 and a cover member 281 for covering the upper portion of the unit main body 280. Note that the cover member 281 is an example of the "first cover member" according to a preferred embodiment of the present invention. The unit main body 280 and the cover member 281 of the vapor separator unit 208 preferably are formed by casting, for example.

In the second preferred embodiment, the vapor separator unit 208 includes a tank section 282 for reserving fuel supplied to the engine section 2 and the low-pressure pump housing section 289 configured to house the low-pressure pump 12. The tank section 282 and the low-pressure pump housing section 289 are respectively configured to be enclosed by the unit main body 280 and the cover member 281.

The suction opening section 12*b* of the low-pressure pump 12 is attached to the unit main body 280 of the vapor separator unit 208 while the discharge opening section 12*c* of the low-pressure pump 12 is attached to the cover member 281 of the vapor separator unit 208. Specifically, a mounting hole 280*a* for suction opening to which the suction opening section 12*b* of the low-pressure pump 12 is mounted is formed in the low-pressure pump housing section 289 of the unit main body 280 of the vapor separator unit 208. In the mounting hole 280*a* for suction opening, the suction opening section 12*b* of the low-pressure pump 12 is fitted via the seal member 13. Also, a mounting hole 281*a* for discharge opening to which the discharge opening section 12*c* of the low-pressure pump 12 is mounted is formed in the cover member 281 of the vapor separator unit 208. In the mounting hole 281*a* for discharge opening, the discharge opening section 12*c* of the low-pressure pump 12 is fitted via the seal member 14.

In the second preferred embodiment, a fuel passage section 280*b* is provided below the mounting hole 280*a* for suction opening in the unit main body 280 of the vapor separator unit 208. The fuel passage section 280*b* is arranged to extend horizontally and is provided with a pipe mounting member 15 that is inserted into one side of the fuel passage section 280*b*. An upper surface of the fuel passage section 280*b* is connected to the lower end of the mounting hole 280*a* for suction opening. Further, a fuel passage section 281*b* is located above the mounting hole 281*a* for discharge opening in the cover member 281 of the vapor separator unit 208. Note that the fuel passage section 281*b* is an example of the "fuel supply path" according to a preferred embodiment of the present invention. The fuel passage section 281*b* preferably includes a channel section 281*c* formed in an upper surface of the cover member 281 to extend horizontally and a metallic lid member 281*d* for covering the channel section 281*c*.

A pipe section 281*e* extending downward is provided in the other side of the channel section 281*c* of the fuel passage section 281*b*. Note that the pipe section 281*e* is an example of the "fuel supply path" and the "inlet" according to a preferred embodiment of the present invention.

In the second preferred embodiment, a mounting hole 281*f* is provided in the channel section 281*c* of the fuel passage section 281*b* to be sandwiched between the mounting hole 281*a* for suction opening and the pipe section 281*e*. The mounting hole 281*f* is configured to penetrate downward from the bottom of the channel section 281*c*. The relief valve 285 is mounted to the mounting hole 281*f*. The lower portion of the mounting hole 281*f* for relief valve 285 is connected to the upper portion of the low-pressure pump housing section 289. The low-pressure pump housing section 289 is configured to house the low-pressure pump 12. Specifically, the low-pressure pump housing section 289 is configured to house the pump main body 12*a* of the low-pressure pump 12.

In the second preferred embodiment, the low-pressure pump housing section 289 preferably is integral with the unit main body 280 of the vapor separator unit 208 so as to be positioned adjacent to the tank section 282. A pipe section 280*c* is connected to the lower portion of the low-pressure pump housing section 289 to extend downward. The pipe section 280*c* preferably is integral with the unit main body 280 of the vapor separator unit 208. The lower portion of the pipe section 280*c* is connected to the other side of the fuel passage section 280*b*. That is, the relief valve 285 is configured to be connected to the suction opening section 12*b* of the low-pressure pump 12.

As configured as described above with the mounting hole 281*f* for relief valve 285, the pipe section 280*c*, and the fuel passage section 280*b*, it is possible to release fuel outward (to the suction side of the low-pressure pump 12) via the relief valve 285, the pipe section 280*c*, and the fuel passage section 280*b* when pressure applied to the fuel flowing through the fuel passage section 280*b* is larger than a predetermined value. In other words, when the tank section 282 is filled with a predetermined amount of fuel, which causes the needle valve 84*a* of the float valve 84 to be closed, fuel is returned to the suction side of the low-pressure pump 12. Note that the mounting hole 281*f*, the low-pressure pump housing section 289, and the pipe section 280*c* constitute the "relief path" of the present invention. A filter 281*g* is disposed upstream of the mounting hole 281*f* for relief valve 285 of the fuel passage section 281*b* as well as upstream of the pipe section 281*e*.

Other constructions of the second preferred embodiment are preferably the same as those of the first preferred embodiment.

In the second preferred embodiment, as described above, the relief path (low-pressure pump housing section 289) in which fuel is released from the relief valve 285 is configured to house the low-pressure pump 12. Thus, the relief path (low-pressure pump housing section 289) covers the low-pressure pump 12, thereby protecting the fuel supply pump 12 from physical shock.

Other effects, operations and advantages of the second preferred embodiment are similar to those of the first preferred embodiment.

Third Preferred Embodiment

Figure 6:
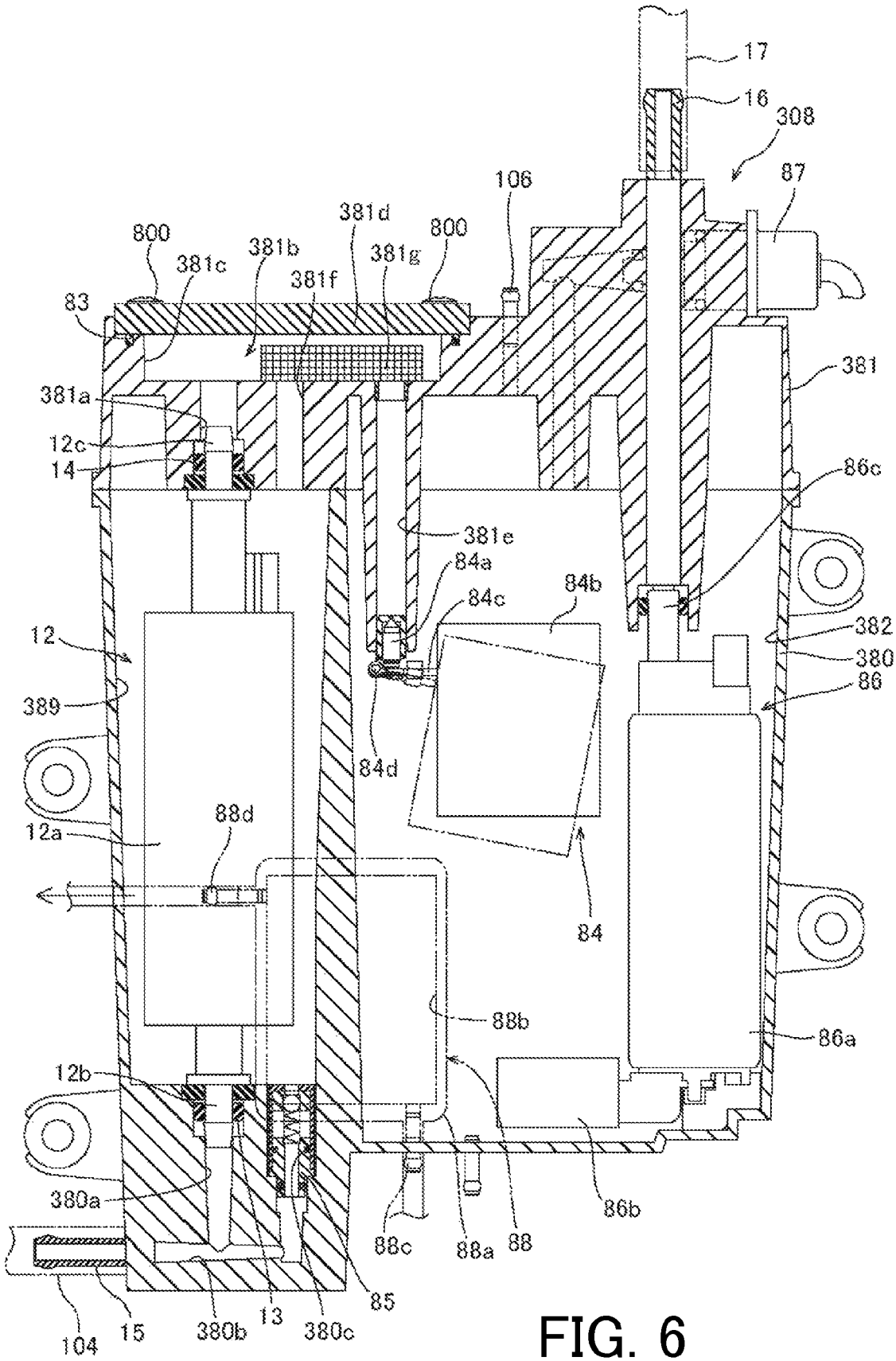
FIG. 6 is a cross-sectional view showing the construction of a vapor separator unit of an outboard motor according to a third preferred embodiment of the present invention.

FIG. 6 is a cross-sectional view illustrating the construction of a vapor separator unit of an outboard motor according to a third preferred embodiment of the present invention. The structure of the vapor separator unit of the outboard motor according to the third preferred embodiment of the present invention will be described hereinafter in detail with reference to FIG. 6. In contrast to the second preferred embodiment, there is described in the third preferred embodiment an example in which a relief valve 385 is provided in the lower portion of a low-pressure pump housing section 389 that constitutes a relief path provided in a vapor separator unit 308.

In the third preferred embodiment, as shown in FIG. 6, the vapor separator unit 308 preferably includes a unit main body 380 that constitutes the main portion of the vapor separator unit 308 and a cover member 381 for covering the upper portion of the unit main body 380. Note that the cover member 381 is an example of the "first cover member" according to a preferred embodiment of the present invention. The unit main body 380 and the cover member 381 of the vapor separator unit 308 are preferably formed by casting, for example.

In the third preferred embodiment, the vapor separator unit 308 includes a tank section 382 for reserving fuel supplied to the engine section 2 and the low-pressure pump housing section 389 configured to house the low-pressure pump 12. The tank section 382 and the low-pressure pump housing section 389 are respectively configured to be enclosed by the unit main body 380 and the cover member 381.

The suction opening section 12*b* of the low-pressure pump 12 is attached to the unit main body 380 of the vapor separator unit 308 while the discharge opening section 12*c* of the low-pressure pump 12 is attached to the cover member 381 of the vapor separator unit 308. Specifically, a mounting hole 380*a* for suction opening to which the suction opening section 12*b* of the low-pressure pump 12 is mounted is formed in the low-pressure pump housing section 389 of the unit main body 380 of the vapor separator unit 308. In the mounting hole 380*a* for suction opening, the suction opening section 12*b* of the low-pressure pump 12 is fitted via the seal member 13. Also, a mounting hole 381*a* for discharge opening to which the discharge opening section 12*c* of the low-pressure pump 12 is mounted is formed in the cover member 381 of the vapor separator unit 308. In the mounting hole 381*a* for discharge opening, the discharge opening section 12*c* of the low-pressure pump 12 is fitted via the seal member 14.

In the third preferred embodiment, a fuel passage section 380*b* is formed below the mounting hole 380*a* for suction opening in the unit main body 380 of the vapor separator unit 308. The fuel passage section 380*b* is arranged to extend horizontally and is provided with the pipe mounting member 15 that is inserted into one side of the fuel passage section 380*b*. An upper surface of the fuel passage section 380*b* is connected to the lower end of the mounting hole 380*a* for suction opening. Further, a fuel passage section 381*b* is formed above the mounting hole 381*a* for discharge opening in the cover member 381 of the vapor separator unit 308. Note that the fuel passage section 381*b* is an example of the "fuel supply path" according to a preferred embodiment of the present invention. The fuel passage section 381*b* preferably includes a channel section 381*c* formed in an upper surface of the cover member 381 to extend horizontally and a metallic lid member 381*d* for covering the channel section 381*c*.

A pipe section 381*e* extending downward is provided in the other side of the channel section 381*c* of the fuel passage section 381*b*. Note that the pipe section 381*e* is an example of the "fuel supply path" and the "inlet" according to a preferred embodiment of the present invention.

In the third preferred embodiment, a pipe section 381*f* is provided in the channel section 381*c* of the fuel passage section 381*b* to be sandwiched between the mounting hole 381*a* for discharge opening and the pipe section 381*e*. The pipe section 381*f* is arranged to connect between the fuel passage section 381*b* and the low-pressure pump housing section 389. The low-pressure pump housing section 389 preferably is integral with the unit main body 380 of the vapor separator unit 308 to be positioned adjacent to the tank section 382. The low-pressure pump housing section 389 is configured to house the low-pressure pump 12. Specifically, the low-pressure pump housing section 389 is configured to house the pump main body 12*a* of the low-pressure pump 12.

In the third preferred embodiment, a mounting hole 380*c* for a valve is provided in the lower portion of the low-pressure pump housing section 389. The mounting hole 380*c* is configured to connect the lower portion of the low-pressure pump housing section 389 and the fuel passage section 380*b*. The relief valve 385 is mounted to the mounting hole 380*c*. That is, the relief valve 385 is configured to be connected to the suction opening section 12*b* of the low-pressure pump 12.

As configured as described above with the pipe section 381*f*, the low-pressure pump housing section 389, and the mounting hole 380*c* for relief valve 385, it is possible to release fuel outward (to the suction side of the low-pressure pump 12) via the low-pressure pump housing section 389 and the mounting hole 380*c* for relief valve 385 when pressure applied to the fuel flowing through the fuel passage section 381*b* is larger than a predetermined value. In other words, when the tank section 382 is filled with a predetermined amount of fuel, which causes the needle valve 84*a* of the float valve 84 to be closed, fuel is returned to the suction side of the low-pressure pump 12. Note that the pipe section 381*f*, the low-pressure pump housing section 389, and the mounting hole 380*c* constitute the "relief path" according to a preferred embodiment of the present invention. A filter 381*g* is disposed upstream of the mounting hole 381*f* for relief valve 385 of the fuel passage section 381*b* as well as upstream of the pipe section 381*e*. The filter 381*g* is configured to cover the mounting hole 381*f* and the pipe section 381*e*.

The other constructions of the third preferred embodiment are the same as those of the second preferred embodiment.

In the third preferred embodiment, as described above, the relief valve 385 is provided in the vicinity of the suction opening section 12*b* of the low-pressure pump 12 to flow fuel to the suction opening section 12*b* side of the low-pressure pump 12 when the tank section 382 is filled with the predetermined amount of fuel. Thus, when the tank section 382 is filled with the predetermined amount of fuel, it is easy to return fuel to the suction opening section 12*b* side of the low-pressure pump 12.

Other effects, operations and advantages of the third preferred embodiment are similar to those of the first and the second preferred embodiments.

Note that the preferred embodiments disclosed in this specification are merely examples in every aspect, and it is intended not to limit the scope of the present invention. The scope of this invention is not defined by the aforementioned description of the preferred embodiments, but by the claims. Also the scope of this invention includes every modification within the equivalent meaning and scope of the claims.

For example, in the first to third preferred embodiments, a relief valve is preferably provided in such a relief path as the fuel passage section. However, the present invention is not limited thereto. Any device such as a pressure regulator other than a relief valve may be applied in such a relief path as the fuel passage section.

In the first to third preferred embodiments, in order to cool the vapor separator unit, a cooling section configured to flow cooling water through the outer wall section of the vapor separator unit is preferably provided. However, the present invention is not limited thereto. For example, a cooling section configured to flow cooling water in the vapor separator unit or in a wall section of the vapor separator unit may be provided.

In the first to third preferred embodiments, a float valve is preferably applied to the closing member. However, the present invention is not limited thereto. For example, any valve member such as a solenoid valve other than a float valve may be applied to the closing member.

In the first to third preferred embodiments, the vapor separator unit is preferably formed by casting, for example. However, the present invention is not limited thereto. For example, the vapor separator unit may be formed by welding a plurality of metallic members or by molding resins, for example.

In the first to third preferred embodiments, gasoline is preferably used for fuel, for example. However, the present invention is not limited thereto. Fuel may be alcohol or other suitable fuel alternative.

In the first to third preferred embodiments, the fuel supply system for a boat of the present invention is preferably applied to an outboard motor. However, the present invention is not limited thereto. The fuel supply system for a boat according to a preferred embodiment of the present invention may be applied to an inboard motor or an inboard/outboard motor in which an engine section is mounted on a hull.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply system for a boat, the fuel supply system comprising:

a second fuel tank arranged to be connected to a first fuel tank mounted on a hull and arranged to contain fuel therein;

a fuel supply pump arranged to discharge the fuel in the first fuel tank to the second fuel tank; and a relief path including an upstream side through which the fuel discharged by the fuel supply pump is returned to a suction side of the fuel supply pump when the second fuel tank is filled with a predetermined amount of fuel; wherein the second fuel tank shares at least one wall with the relief path; and the upstream side of the relief path is upstream of an inlet of the second fuel tank.

2. The fuel supply system for a boat according to claim 1, wherein the second fuel tank is integral with a fuel supply path arranged to connect a discharge side of the fuel supply pump and a tank section of the second fuel tank.

3. The fuel supply system for a boat according to claim 2, wherein the fuel supply system includes a closing member disposed in the tank section of the second fuel tank to close the inlet when the tank section of the second fuel tank is filled with the predetermined amount of fuel.

4. The fuel supply system for a boat according to claim 3, wherein the fuel supply path is connected to the relief path, and the fuel supply system further includes a filter positioned in the fuel supply path at the upstream side of the relief path and at an upstream side of the inlet.

5. The fuel supply system for a boat according to claim 4, wherein the filter is arranged to cover the relief path and the inlet.

6. The fuel supply system for a boat according to claim 2, wherein the second fuel tank includes a tank body and a first cover member configured to cover an upper portion of the tank body, and the fuel supply path is integral with the first cover member of the second fuel tank.

7. The fuel supply system for a boat according to claim 6, wherein the relief path is integral in the second fuel tank so as to lie between the tank body and the first cover member.

8. The fuel supply system for a boat according to claim 6, wherein a suction opening of the fuel supply pump is attached to the tank body of the second fuel tank so as to be connected to the relief path.

9. The fuel supply system for a boat according to claim 6, wherein a discharge opening of the fuel supply pump is attached to the first cover member of the second fuel tank so as to be connected to the fuel supply path.

10. The fuel supply system for a boat according to claim 1, further comprising a cooling section through which cooling water flows and that is located on an outer wall section of the second fuel tank and is arranged to cool the second fuel tank.

11. The fuel supply system for a boat according to claim 10, wherein the cooling section is configured to cool the fuel flowing through the relief path and the fuel reserved in the tank section of the second fuel tank.

12. The fuel supply system for a boat according to claim 10, wherein the cooling section includes a second cover member configured to cover the outer wall section of the second fuel tank and is configured such that cooling water flows between the second cover member and the outer wall section of the second fuel tank.

13. The fuel supply system for a boat according to claim 1, wherein the relief path is configured to house the fuel supply pump.

14. The fuel supply system for a boat according to claim 1, wherein the relief path includes a relief valve that is disposed in a vicinity of the suction opening of the fuel supply pump in the relief path and allows fuel to flow into the suction opening of the fuel supply pump when the second fuel tank is filled with the predetermined amount of fuel.

15. An outboard motor comprising:

an engine;

a second fuel tank arranged to be connected to a first fuel tank mounted on a hull and arranged to contain fuel supplied to the engine;

a fuel supply pump arranged to discharge the fuel reserved in the first fuel tank to the second fuel tank side; and a relief path including an upstream side through which the fuel discharged by the fuel supply pump is returned to a suction side of the fuel supply pump when the second fuel tank is filled with a predetermined amount of fuel; wherein the second fuel tank shares at least one wall with the relief path; and the upstream side of the relief path is upstream of an inlet of the second fuel tank.

16. The fuel supply system for a boat according to claim 1, further comprising a fuel pump disposed inside the second fuel tank to discharge the fuel from the second fuel tank through a discharge pipe.

17. The fuel supply system for a boat according to claim 1, further comprising a pressure regulator disposed in a discharge pipe of the second fuel tank to adjust a pressure of the fuel in the discharge pipe, the pressure regulator connected to a return passage to return fuel from the discharge pipe to the second fuel tank.

* * * * *